US007710090B1

(12) United States Patent
Kimura

(10) Patent No.: US 7,710,090 B1
(45) **Date of Patent: *May 4, 2010**

(54) SERIES REGULATOR WITH FOLD-BACK OVER CURRENT PROTECTION CIRCUIT

(75) Inventor: Hiroyuki Kimura, Sendai (JP)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/371,931

(22) Filed: Feb. 17, 2009

(51) Int. Cl.
*G05F 1/569* (2006.01)
*G05F 1/571* (2006.01)
*G05F 1/573* (2006.01)

(52) U.S. Cl. ..... 323/276; 323/277

(58) Field of Classification Search ..... 323/226, 323/265, 273–280
See application file for complete search history.

(56) References Cited

U.S. PATENT DOCUMENTS 4,531,173 A 7/1985 Yamada
5,208,718 A 5/1993 Fox
6,703,813 B1 * 3/2004 Vladislav et al. ..... 323/276
6,807,040 B2 * 10/2004 Ivanov et al. ..... 361/93.9
6,952,091 B2 * 10/2005 Bansal ..... 323/277
7,042,280 B1 5/2006 Huang et al.
7,078,885 B2 * 7/2006 Prexl ..... 323/277
7,081,742 B2 * 7/2006 Ito et al. ..... 323/273
7,102,336 B2 * 9/2006 Adachi ..... 323/276
7,129,773 B2 * 10/2006 Ito et al. ..... 323/277
7,173,401 B1 * 2/2007 Huang ..... 323/277
7,183,755 B2 * 2/2007 Itoh et al. ..... 323/274
7,268,523 B2 * 9/2007 Itoh ..... 323/276
7,315,154 B2 * 1/2008 Sugiura ..... 323/276
7,339,775 B2 3/2008 Kimura
7,358,713 B2 * 4/2008 Hauser ..... 323/316
7,362,080 B2 * 4/2008 Sohn et al. ..... 323/277
7,411,376 B2 * 8/2008 Zhang ..... 323/277

(Continued)

FOREIGN PATENT DOCUMENTS

JP 2003216252 A 7/2003

(Continued)

*Primary Examiner*—Bao Q Vu
*Assistant Examiner*—Jue Zhang
(74) *Attorney, Agent, or Firm*—Charles Bergere

(57) ABSTRACT

A series regulator with fold-back over current protection has a high ratio current mirror circuit located between a sense transistor and its voltage output terminal. The series regulator receives an input voltage at an input terminal and generates a stable output voltage at an output terminal. A first amplifier receives a reference voltage. An output transistor is connected between the input terminal and the output terminal and has a gate connected to an output of the first amplifier. A current limiting transistor and the current sense transistor are connected to the input terminal, the output terminal of the first amplifier, and the gate of the output transistor. A voltage divider, connected between the output terminal and ground, generates first and second voltage signals. The first voltage signal is provided to a non-inverting input of the first amplifier. A first current source is connected to the voltage divider and receives the second voltage signal. The current mirror circuit is connected to the current sense transistor, the first current source, and the output terminal. The current mirror circuit returns the sense current to the output terminal and controls the drain-source voltage of the sense transistor.

12 Claims, 3 Drawing Sheets

U.S. PATENT DOCUMENTS

| | | | | |
|---|---|---|---|---|
| 7,414,384 | B2 | 8/2008 | Kimura | |
| 2002/0181180 | A1* | 12/2002 | Ivanov et al. | 361/93.9 |
| 2006/0017495 | A1* | 1/2006 | Lam et al. | 327/538 |
| 2008/0048626 | A1 | 2/2008 | Kimura | |
| 2008/0191671 | A1 | 8/2008 | Shikata | |
| 2008/0191673 | A1 | 8/2008 | Kimura | |
| 2008/0208513 | A1 | 8/2008 | Dupuy et al. | |
| 2008/0225456 | A1 | 9/2008 | Daio et al. | |
| 2008/0258691 | A1 | 10/2008 | Lai et al. | |
| 2008/0258696 | A1 | 10/2008 | Kimura | |
| 2009/0273323 | A1* | 11/2009 | Kimura | 323/265 |

FOREIGN PATENT DOCUMENTS

| | | | |
|---|---|---|---|
| JP | 2005327164 | A | 11/2005 |

* cited by examiner

SERIES REGULATOR WITH FOLD-BACK OVER CURRENT PROTECTION CIRCUIT

FIELD OF THE INVENTION

The present invention relates to relates to a voltage regulator and more particularly to a series regulator that has a fold-back type over current protection circuit.

BACKGROUND OF THE INVENTION

Voltage regulator circuits are used in semiconductor devices to provide a stable DC (Direct Current) output voltage with little fluctuation to a load. Such regulators are also known as Low Drop Out (LDO) regulators. Typically, LDO regulators rely on feedback voltage to maintain a constant output voltage. That is, an error signal whose value is a function of the difference between the actual output voltage and a nominal value is amplified and used to control current flow through a pass device such as a power transistor, from the power supply to the load. The drop-out voltage is the value of the difference between the power supply voltage and the desired regulated voltage. The low drop out nature of the regulator makes it useful in portable devices such as cameras, which have a battery power supply.

Over-current protection is typically required when a short-circuit condition occurs in the output of a regulator circuit. Over-current protection can be achieved by monitoring the current delivered to a load and then clamping the current when it exceeds a predetermined maximum level. Such circuits may require a reference current that is greater than the bias current of the rest of the regulator, or have floating currents.

For small, battery-powered devices, it is important to conserve the charge in the battery. Thus, there is a need for a series regulator that does not require large reference currents or have floating current, and can be readily implemented on a semiconductor integrated circuit.

BRIEF DESCRIPTION OF THE DRAWINGS

The invention, together with objects and advantages thereof, may best be understood by reference to the following description of the presently preferred embodiment together with the accompanying drawings in which.

DETAILED DESCRIPTION OF PREFERRED EMBODIMENTS

Figure 1:
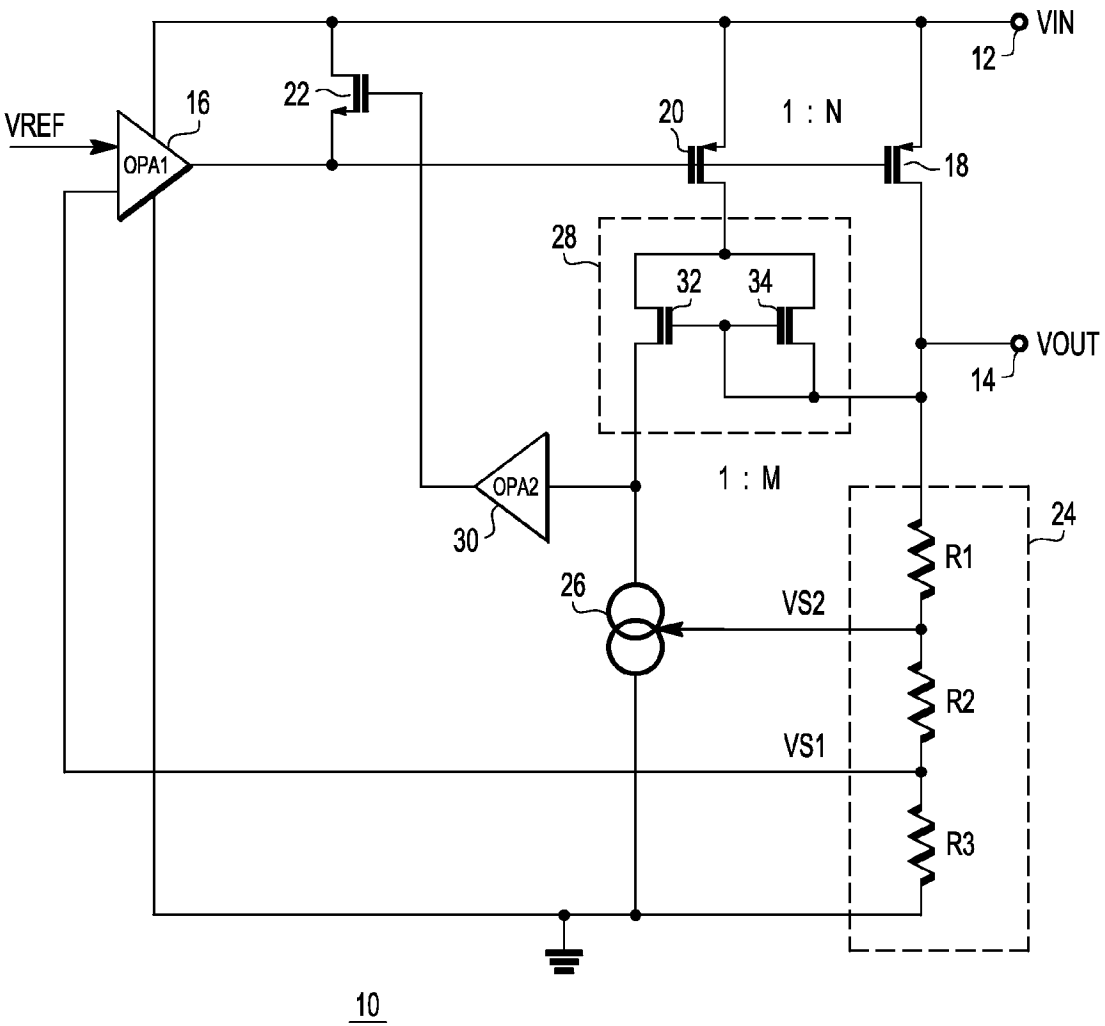
FIG. 1 is a schematic circuit diagram of a series regulator with an over current protection circuit in accordance with an embodiment of the present invention.

The detailed description set forth below in connection with the appended drawings is intended as a description of presently preferred embodiments of the invention, and is not intended to represent the only forms in which the present invention may be practiced. It is to be understood that the same or equivalent functions may be accomplished by different embodiments that are intended to be encompassed within the spirit and scope of the invention. In the drawings, like numerals are used to indicate like elements throughout.

In one embodiment, the present invention provides a series regulator with an over current protection circuit. The series regulator receives an input voltage at an input terminal and generates an output voltage and an output current at an output terminal. A first amplifier circuit, connected between the input terminal and ground, has an inverting input that receives a reference voltage, a non-inverting input, and an output terminal. An output transistor is connected between the input terminal and the output terminal, and has a gate connected to the output terminal of the first amplifier circuit. A current sense transistor has a source connected to the input terminal, and a gate connected to the output terminal of the first amplifier circuit. The current sense transistor generates a sense current. A current limiting transistor is connected between the input terminal and the output terminal of the first amplifier circuit. The current limiting transistor controls a voltage at the gate of the output transistor. An attenuator circuit is connected between the output terminal and ground. The attenuator circuit generates first and second voltage signals, wherein the first voltage signal is connected to a non-inverting input terminal of the first amplifier circuit. A first current source is connected to the attenuator circuit and receives the second voltage signal therefrom. A high ratio current mirror circuit is connected to the current sense transistor, the first current source, and the output terminal. The current mirror circuit receives the sense current from the current sense transistor and returns the sense current to the output terminal. A second amplifier circuit has a non-inverting input that receives a voltage input and is connected to a node between an output of the first current source and the current mirror circuit, and an output connected to a gate of the current limiting transistor. The current mirror circuit controls the input voltage of the second amplifier such that the output current is proportional to a current of the first current source.

In another embodiment, the present invention provides a series regulator with an over current protection circuit, wherein the series regulator receives an input voltage at an input terminal and generates an output voltage and an output current at an output terminal. A first amplifier circuit, connected between the input terminal and ground, having an inverting input that receives a reference voltage, a non-inverting input, and an output terminal. An output transistor is connected between the input terminal and the output terminal, and has a gate connected to the output terminal of the first amplifier circuit. A current sense transistor having a source connected to the input terminal, and a gate connected to the output terminal of the first amplifier circuit, generates a sense current. A current limiting transistor connected between the input terminal and the output terminal of the first amplifier circuit, controls a voltage at the gate of the output transistor. An attenuator circuit connected between the output terminal and ground, generates first and second voltage signals, wherein the first voltage signal is connected to a non-inverting input terminal of the first amplifier circuit. A voltage-to-current converter is connected to the attenuator circuit and receiving the second voltage signal therefrom. A first current source is connected between the voltage-to-current converter and the ground. A high ratio current mirror circuit connected to the current sense transistor, the voltage-to-current converter, and the output terminal, receives the sense current from the current sense transistor and returns the sense current to the output terminal. A cascode device is connected to a node between the voltage-to-current converter and the current mirror circuit. A second current source is connected between the input terminal and the cascode device. A third current source is connected between the cascode device and the ground. The current mirror circuit controls the gate voltage of the output transistor such that the output current generated at the output terminal is proportional to an output current of the voltage-to-current converter.

A series regulator 10 in accordance with an embodiment of the present invention will now be discussed with reference to FIG. 1. The series regulator 10 receives an input voltage VIN at an input terminal 12 and generates an output voltage VOUT at an output terminal 14. A first amplifier circuit 16 is connected between the input terminal 12 and ground. The first amplifier circuit 16 has an inverted input that receives a reference voltage VREF, a non-inverting input, and an output terminal. VIN can range from 15V to 40V. For VOUT of 9V, VREF can be 1.2V, although other voltage values are possible but VREF should be less than VOUT.

An output transistor 18 is connected between the input terminal 12 and the output terminal 14. A gate of the output transistor 18 is connected to the output terminal of the first amplifier circuit 16. A current sense transistor 20 has a source connected to the input terminal 14, and a gate connected to the output terminal of the first amplifier circuit 16. The current sense transistor 20 generates a sense current. A current limiting transistor 22 is connected between the input terminal 12 and the output terminal of the first amplifier circuit 16. The current limiting transistor 22 controls a voltage at the gate of the output transistor 18.

In one embodiment of the invention, the current limiting transistor 22 comprises a first NMOS transistor, the current limiting transistor 20 comprises a first PMOS transistor, and the output transistor 18 comprises a second PMOS transistor. The first NMOS transistor has a source connected to the output terminal of the first amplifier circuit 16, and a drain connected to the input terminal 12, and a gate. The first NMOS transistor 22 controls a gate voltage of the output transistor 18. The first PMOS transistor has a source connected to the input terminal 12, a drain connected to the current mirror circuit 28, and a gate connected to the output terminal of the first amplifier circuit 16. The second PMOS transistor has a source connected to the input terminal 12, a drain connected to the output terminal 14, and a gate connected to the output terminal of the first amplifier circuit 16.

An attenuator circuit 24 is connected between the output terminal 14 and ground. The attenuator circuit 24 generates first and second voltage signals VS1 and VS2. The first voltage signal VS1 is connected to a non-inverting input terminal of the first amplifier circuit 16. In one embodiment of the invention, the attenuator circuit 24 comprises a voltage divider having at least first, second and third series connected resistors R1, R2 and R3. The first resistor R1 has one terminal connected to the output terminal 14 and its other terminal connected to the second resistor R2. The third resistor R3 is connected between the second resistor R2 and the ground. The first voltage signal VS1 is generated at a node located between the second and third resistors R2, R3, and the second voltage signal VS2 is generated at a node located between the first and second resistors R1 and R2. The resistance of the attenuator circuit 24 (R1+R2+R3) can be from 10 k ohms to 1 Mohm. In one embodiment of the invention, the resistance of the attenuator circuit 24 is 360 kohm.

A first current source 26 is connected to the attenuator circuit 24 and receives the second voltage signal therefrom. A high ratio current mirror circuit 28 is connected to the current sense transistor 20, the first current source 26, and the output terminal 14. The high ratio current mirror circuit 28 receives the sense current from the current sense transistor 20 and returns the sense current to the output terminal 14.

A second amplifier circuit 30 has a non-inverting input connected to a node between an output of the first current source 26 and the high ratio current mirror circuit 28, and an output connected to a gate of the current limiting transistor 22.

In one embodiment of the invention, the high ratio current mirror circuit 28 comprises third and fourth PMOS transistors 32 and 34. The third PMOS transistor 32 has a source connected to the drain of the current sense transistor 20, and a drain connected to the output of the first current source 26 and the non-inverting input of the second amplifier circuit 30. The fourth PMOS transistor 34 has a source connected to the source of the third PMOS transistor 32 and the drain of the current sense transistor 20, a drain connected to the output terminal 14, and a gate connected to its drain and to the gate of the third PMOS transistor 32.

The current mirror circuit 28 generates current at the third PMOS transistor 32 that is proportional to the sense current or the output current (current at the output terminal 14). The current mirror circuit 28 also controls a drain-source voltage (VDS) of the current sense transistor 20 such that the output voltage generated at the output terminal 14 is equal to the reference voltage VREF. More particularly, the current mirror circuit 28 controls VDS of the current sense transistor 20 to keep it close to VDS of the output transistor 18 in order to manage the current ratio between these constant. The current mirror circuit 28 returns most of sense current to the output terminal 14. While there is a voltage difference of VGS of the fourth PMOS transistor 34, for large drop out (VDS of the output transistor 18) this voltage difference is negligible and at least the error current can be compensated for because the VDS change of both the current sense transistor 20 and the output transistor 18 is very close. The regulated output voltage has a target of Vout=Vref*(R1+R2+R3)/R3. If VS1>Vref then output voltage of the first amplifier circuit 16 will go up, which will make the output transistor 18 turn off, and if VS1<Vref then the output transistor 18 will turn on.

In one embodiment of the invention, the current sense transistor 20 and the output transistor 18 have a ratio of 1:N, and the third and fourth PMOS transistors 32, 34 of the current mirror circuit 28 have a ratio of 1:M, where N and M have values in a range of 10 to 100. In one embodiment of the invention, N has a value of about 100 and M has a value of about 26. The high ratio provides for a higher return ratio of the sense current to the output terminal 14, or lower thrown current to the ground. The high ratio also provides a low output current from the current mirror circuit 28. This allows the rest of the regulator circuit to be constructed with small transistors.

Figure 2:
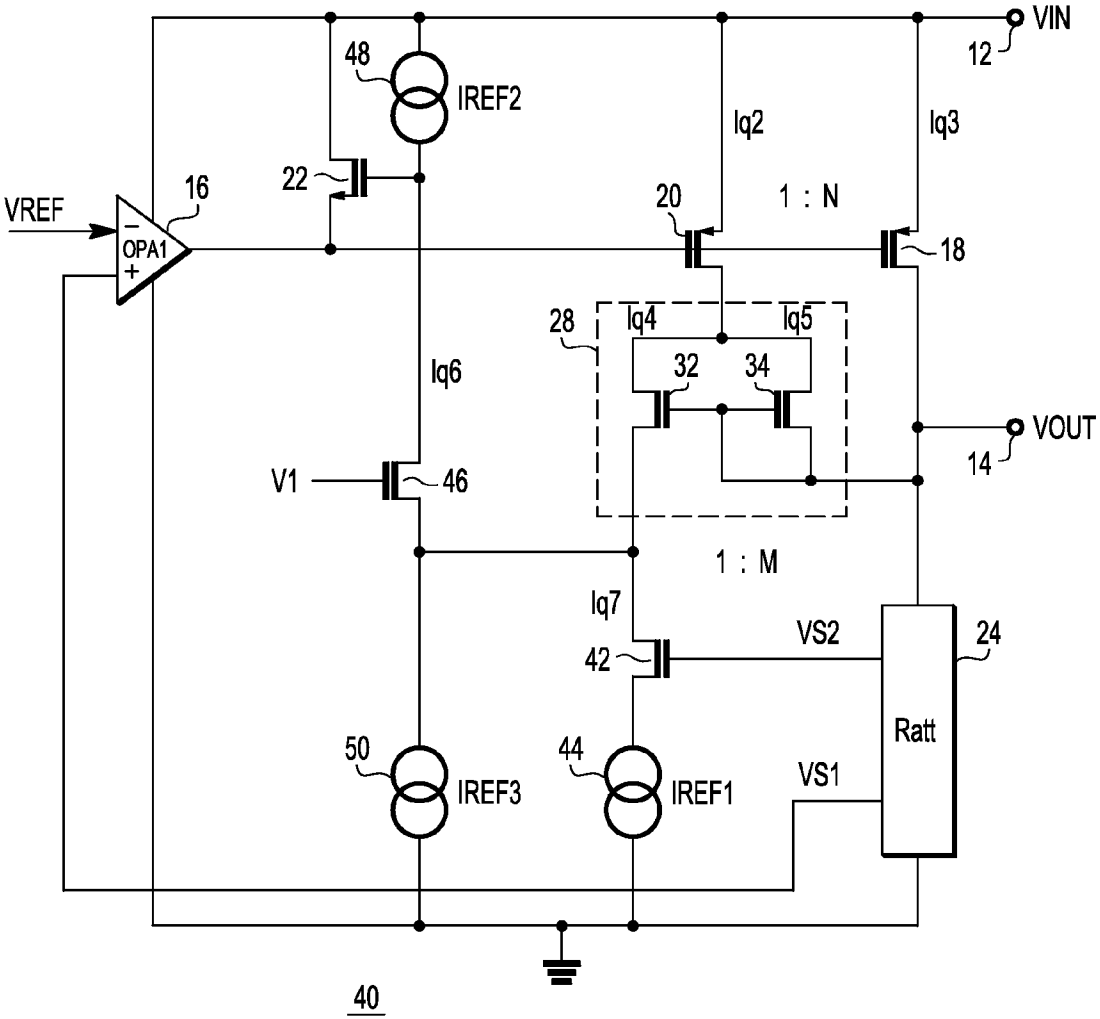
FIG. 2 is a schematic circuit diagram of a series regulator with an over current protection circuit in accordance with another embodiment of the present invention.

Referring now to FIG. 2, series regulator 40 with an over current protection circuit in accordance with another embodiment of the present invention is shown. The series regulator 40 receives an input voltage VIN at an input terminal 12 and generates a stable output voltage VOUT at an output terminal 14. Like the series regulator 10 (FIG. 1), the series regulator 40 includes the first amplifier circuit 16, the output transistor 18, the current sense transistor 20, the current limiting transistor 22, the attenuator circuit 24, and the high ratio current mirror circuit 28. As discussed above, the attenuator circuit 24 generates first and second voltage signals VS1 and VS2. As these elements have been described above with reference to FIG. 1, a repetitive description of these elements is not required for one of skill in the art to understand the invention.

The series regulator 40 also includes a voltage-to-current converter 42 connected to the attenuator circuit 24 and receiving the second voltage signal VS2 therefrom. A first current source 44 is connected between the voltage-to-current converter 42 and ground. A cascode device 46 is connected to a node between the voltage-to-current converter 42 and the current mirror circuit 28. A second current source 48 is connected between the input terminal 12 and the cascode device 46. A third current source 50 is connected between the cascode device 46 and the ground.

In one embodiment of the invention, the current limiting transistor 22 comprises a first NMOS transistor having a drain connected to the input terminal 12, a source connected to the output terminal of the first amplifier circuit 16, and a gate connected to a node between the second current reference 48 and the cascode device 46. The current sense transistor 20 comprises a first PMOS transistor having a source connected to the input terminal 12, a drain connected to the current mirror circuit 28, and a gate connected to the output terminal of the first amplifier circuit 16. The output transistor 18 comprises a second PMOS transistor having a source connected to the input terminal 12, a drain connected to the output terminal 14, and a gate connected to the output terminal of the first amplifier circuit 16.

The attenuator circuit 24 is arranged the same as with the embodiment shown in FIG. 1 and includes the three series connected resistors R1, R2 and R3, and generates first and second voltage signals. The current mirror circuit 28 also is arranged as that shown in FIG. 1 and includes the third and fourth PMOS transistors. Also as shown in the embodiment of FIG. 1, the current sense transistor 20 and the output transistor 18 have a ratio of 1:N, and the third and fourth PMOS transistors have a ratio of 1:M, where N and M have values in a range of about 10 to about 100.

In one specific embodiment of the invention, N has a value of 100 and M has a value of 26. These particular values were selected because M*N comes from the ratio between the output current and current close to the reference current used in the circuit 10, and N comes from the structure of the output transistor 18. Usually the output transistor 18 comprises a number of parallel small unit transistors. If the current sense transistor 20 is made with a single unit transistor, the ratio, N will be the number of the unit transistors used in the output transistor 18.

The cascode device 46 comprises a second NMOS transistor having a source connected to the third current source 50 and to a node between the drain of the third PMOS transistor and the voltage-to-current converter 42, a drain connected to the gate of the current limiting transistor 22 and to the second current reference 48, and a gate that receives a first voltage input signal V1. The first voltage input signal V1 can be generated from the cascode bias voltage commonly used in the other circuit elements such as a bias voltage in the first amplifier circuit 16, for convenience. The voltage input signal V1, for example, is 1.2V, or between 1.1V and 1.3V. The minimum voltage (V1_min) comes from Vgs of the cascode device 46 plus the minimum voltage of the first or third current sources 44 or 50. For example, if Vgs=800 mV and the minimum voltage of the third current source 50 is 300 mV, V1_min=1.1V. The maximum voltage (V1_max) comes from VGS, the minimum VDS of the third PMOS transistor 32 (VDS_32) and the minimum VOUT (VOUT_min). Where each VGS is the same, V1_max=Vout_min+VGS_34−VDS_32+VGS_46=VOUT_min+2*VGS−VDS_32. If Vout_min=0V, VGS=800 mV and VDS32=300 mV then V1_max=1.3V. The output current of the cascode 46, Ig6, can be written as Ig6=Ig7+Iref3−Ig4.

The voltage-to-current converter 42 comprises a third NMOS transistor having a source connected to the first current reference 44, a drain connected to the drain of the third PMOS transistor and the source of the second NMOS transistor, and a gate connected to the node located between the first and second resistors R1 and R2 of the attenuator circuit 24 and receiving the second voltage signal VS2 therefrom. As discussed above, the current mirror circuit 28 controls the gate voltage of the output transistor 18 through the current limiting transistor 22 such that the output current is proportional to the output current of the voltage-to-current converter 42.

Figure 3A:
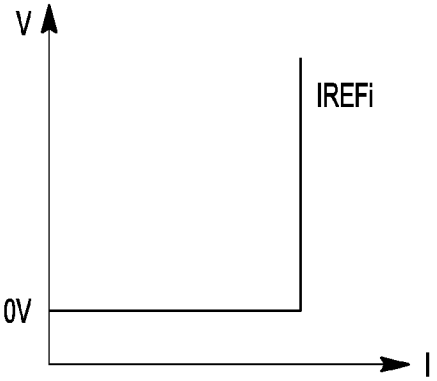
FIG. 3A is a current versus voltage graph of a reference current for the circuit of FIG. 2.

Referring now to FIG. 3A, FIG. 3A is a current versus voltage graph of a reference current for the circuit of FIG. 2. More particularly, FIG. 3A shows the voltage-current characteristic of the first, second and third current sources 44, 48, 50. Where a voltage across a device is 0, the current is also 0. Where the voltage is higher than the Vmin, the current is Irefi, i is 1 to 3 indicating the first to third current sources 44, 48, 50. Where the voltage is lower than Vmin, the current is lower than Irefi. To keep the current constant, the voltage across the device has to be higher than the Vmin. An example of Vmin is 300 mV.

Figure 3B:
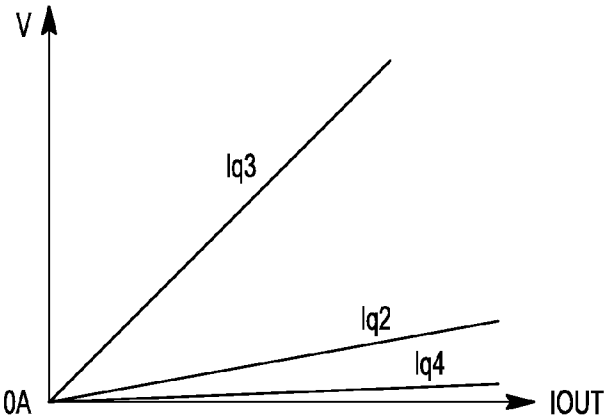
FIG. 3B is a current versus voltage graph showing the current through various transistors of the circuit of FIG. 2.

FIG. 3B is a current versus voltage graph showing the currents through various transistors of the circuit of FIG. 2; that is Iout vs. currents of the output transistor 18 (Ig3), the sense transistor 20 (Ig2) and the current mirror circuit 28 (Ig4). As can be seen from the graph, these currents are proportional to each other. So Ig4 can be used to monitor the output current (IOUT) (i.e., current at the output terminal 14). Ig4 can be calculated using the following formula, Ig4=Iout/(M*N+M+N).

Figure 3C:
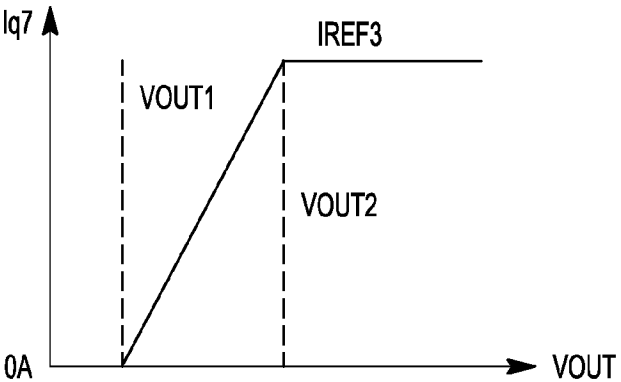
FIG. 3C is a voltage versus current graph illustrating voltage values for a reference current of the circuit of FIG. 2.

FIG. 3C is a voltage versus current graph illustrating voltage values for a reference current of the circuit of FIG. 2. FIG. 3C shows Vout vs. current Ig7. The current Ig7 is the output current of the voltage-to-current converter 42. The current Ig7 is dependent on VS2, and VS2 is proportional to Vout, so the current Ig7 is a function of Vout. The current Ig7 is 0 when Vout<vout1. At Vout>vout1, the current increases. The voltage-to-current converter 42 has a maximum current of Iref1 because the source of the voltage-to-current converter 42 is connected to the first current source 44. At Vout=vout2, the current hits Iref1 so at Vout>vout2 the current has a value of Iref1.

In one embodiment of the invention, the series regulator 40 is used to generate a 9V output using an input voltage of between 15V to 40V, and with the output transistor 18 having a maximum gate voltage of 10V. A 9V output voltage leaves 1V margin to the maximum gate voltage. Although the current through the sense transistor 20 is small, power loss is proportional to VOUT and 9V is relatively high so the sense current goes to VOUT, which prevents power loss. The regulator 10, 40 may be implemented in CMOS or using bipolar transistors.

As is evident from the foregoing discussion, the present invention provides low drop out series regulator having a fold-back over current protection circuit and reduced consumption. Thus, the series regulator circuit of the present invention is ideal for integrated circuit applications for small, portable devices powered with a battery.

The description of the preferred embodiment of the present invention has been presented for purposes of illustration and description, but is not intended to be exhaustive or to limit the invention to the forms disclosed. It will be appreciated by those skilled in the art that changes could be made to the embodiments described above without departing from the broad inventive concept thereof. It is understood, therefore, that this invention is not limited to the particular embodiment disclosed, but covers modifications within the spirit and scope of the present invention as defined by the appended claims.

The invention claimed is:

1. A series regulator with an over current protection circuit, wherein the series regulator receives an input voltage at an input terminal and generates an output voltage and an output current at an output terminal, the series regulator comprising:

a first amplifier circuit, connected between the input terminal and ground, having an inverting input that receives a reference voltage, a non-inverting input, and an output terminal;

an output transistor connected between the input terminal and the output terminal, wherein a gate of the output transistor is connected to the output terminal of the first amplifier circuit;

a current sense transistor having a source connected to the input terminal, and a gate connected to the output terminal of the first amplifier circuit, wherein the current sense transistor generates a sense current;

a current limiting transistor connected between the input terminal and the output terminal of the first amplifier circuit, wherein the current limiting transistor controls a voltage at the gate of the output transistor;

an attenuator circuit connected between the output terminal and ground, the attenuator circuit generating first and second voltage signals, wherein the first voltage signal is connected to a non-inverting input terminal of the first amplifier circuit;

a voltage-to-current converter connected to the attenuator circuit and receiving the second voltage signal therefrom;

a first current source connected between the voltage-to-current converter and the ground;

a high ratio current mirror circuit connected to the current sense transistor, the voltage-to-current converter, and the output terminal, wherein the current mirror circuit receives the sense current from the current sense transistor and returns the sense current to the output terminal;

a cascode device connected to a node between the voltage-to-current converter and the current mirror circuit;

a second current source connected between the input terminal and the cascode device; and a third current source connected between the cascode device and the ground, wherein the current mirror circuit controls the gate voltage of the output transistor such that the output current generated at the output terminal is proportional to an output current of the voltage-to-current converter.

2. The series regulator of claim 1, wherein the current limiting transistor comprises a first NMOS transistor having a drain connected to the input terminal, a source connected to the output terminal of the first amplifier circuit, and a gate connected to a node between the second current reference and the cascode device.

3. The series regulator of claim 2, wherein the current sense transistor comprises a first PMOS transistor having a source connected to the input terminal, a drain connected to the current mirror circuit, and a gate connected to the output terminal of the first amplifier circuit.

4. The series regulator of claim 3, wherein the output transistor comprises a second PMOS transistor having a source connected to the input terminal, a drain connected to the output terminal, and a gate connected to the output terminal of the first amplifier circuit.

5. The series regulator of claim 4, wherein the attenuator circuit comprises a voltage divider having at least first, second and third series connected resistors, wherein the first resistor has one terminal connected to the output terminal, and the third resistor has one terminal connected to the ground, and wherein the first voltage signal of the attenuator circuit is generated at a node located between the second and third resistors, and the second voltage signal of the attenuator circuit is generated at a node located between the first and second resistors.

6. The series regulator of claim 5, wherein the current mirror circuit comprises:

a third PMOS transistor having a source connected to the drain of the current sense transistor, and a drain connected to the voltage-to-current converter; and a fourth PMOS transistor having a source connected to the source of the third PMOS transistor, a drain connected to the output terminal, and a gate connected to its drain and to the gate of the third PMOS transistor, wherein the current sense transistor and the output transistor have a ratio of 1:N, and the third and fourth PMOS transistors have a ratio of 1:M, and N and M have values in a range of about 10 to about 100.

7. The series regulator of claim 6, wherein the cascode device comprises a second NMOS transistor having a source connected to the third current source and to a node between the drain of the third PMOS transistor and the voltage-to-current converter, a drain connected to the gate of the current limiting transistor and to the second current reference, and a gate that receives a first voltage input signal.

8. The series regulator of claim 7, wherein the voltage-to-current converter comprises a third NMOS transistor having a source connected to the first current reference, a drain connected to the drain of the third PMOS transistor and the source of the second NMOS transistor, and a gate connected to the node located between the first and second resistors of the attenuator circuit and receiving the second voltage signal therefrom.

9. The series regulator of claim 8, wherein N has a value of about 100 and M has a value of about 26.

10. A series regulator with an over current protection circuit, wherein the series regulator receives an input voltage at an input terminal and generates an output voltage at an output terminal, the series regulator comprising:

a first amplifier circuit, connected between the input terminal and ground, having an inverting input that receives a reference voltage, a non-inverting input, and an output terminal;

a current limiting transistor comprising a first NMOS transistor having a source connected to the output terminal of the first amplifier circuit, a drain connected to the input terminal, and a gate;

a current sense transistor comprising a first PMOS transistor having a source connected to the input terminal, and a gate connected to the output terminal of the first amplifier circuit, wherein the current sense transistor generates a sense current;

an output transistor comprising a second PMOS transistor having a source connected to the input terminal, a drain connected to the output terminal, and a gate connected to the output terminal of the first amplifier circuit;

an attenuator circuit comprising a voltage divider circuit having at least three series connected resistors, a first resistor being connected to the output terminal, a third resistor being connected to the ground, and a second resistor being connected between the first and third resistors, wherein a first voltage signal is generated at a node between the second and third resistors, and a second voltage signal being generated at a node between the first and second resistors, wherein the first voltage signal is provided to a non-inverting input terminal of the first amplifier circuit;

a cascode device comprising a second NMOS transistor having a drain connected to a gate of the first NMOS transistor;

a voltage-to-current converter comprising a third NMOS transistor having a drain connected to a source of the second NMOS transistor and a gate connected to the attenuator circuit and receiving the second voltage signal therefrom;

a first current source connected between a source of the third NMOS transistor and the ground;

a high ratio current mirror circuit comprising third and fourth PMOS transistors, wherein the third PMOS transistor has a source connected to a drain of the first PMOS transistor, and a drain connected to the drain of the third NMOS transistor, and wherein the fourth PMOS transistor has source connected to the source of the third PMOS transistor, a drain connected to the output terminal, and a gate connected to its drain and to a gate of the third PMOS transistor, and wherein the current mirror circuit receives the sense current from the current sense transistor and returns the sense current to the output terminal;

a second current source connected between the input terminal and the drain of the second NMOS transistor; and a third current source connected between the source of the second NMOS transistor and the ground, wherein the current mirror circuit controls the gate voltage of the output transistor such that the output current generated at the output terminal is proportional to an output current of the voltage-to-current converter.

11. The series regulator of claim 10, wherein the current sense transistor and the output transistor have a ratio of 1:N, and the third and fourth PMOS transistors have a ratio of 1:M, and N and M have values in a range of about 10 to about 100.

12. The series regulator of claim 11, wherein N has a value of about 100 and M has a value of about 26.

* * * * *